United States Patent [19]

Lortie

[11] Patent Number: 4,968,048

[45] Date of Patent: Nov. 6, 1990

[54] CADDY FOR BASEBALL AND SOFTBALL BATS

[76] Inventor: Fernand Lortie, 33 Val des Bois, Laval, Canada, H7H 2A9

[21] Appl. No.: 498,396

[22] Filed: Mar. 26, 1990

[51] Int. Cl.[5] ..... B62B 1/26

[52] U.S. Cl. ..... 280/47.19; 150/166; 206/315.1; 211/13; 211/70.2; 280/47.26; 294/146; 294/159

[58] Field of Search ..... 280/47.17, 47.19, 47.24, 280/47.26, DIG. 6, 47.35; 206/315.3, 315.4, 315.1; 150/159, 166; 211/70.2, 70.6, 60.1, 13; 294/146, 159

[56] References Cited

U.S. PATENT DOCUMENTS

| | | | |
|---|---|---|---|
| 470,567 | 3/1892 | Hitch | 211/70.6 |
| 2,165,665 | 7/1939 | Thompson | 206/315.4 |
| 3,531,136 | 9/1970 | Mobley | 280/47.19 |
| 3,869,137 | 3/1975 | Byrom | 280/47.35 |
| 4,153,264 | 5/1979 | Pfister | 280/DIG. 6 |
| 4,193,495 | 3/1980 | Keeley | 294/143 |
| 4,227,710 | 10/1980 | Laub | 280/47.33 |

*Primary Examiner*—Charles A. Marmor
*Assistant Examiner*—Eric Culbreth

[57] ABSTRACT

A cart for carrying baseball equipment featuring a protective cover is disclosed. The cart is formed of a rigid cylindrical member having an open upper end. Clips are provided to retain a plurality of baseball bats around the member. The cover is adapted to surround the cart in an unfurled use configuration and stored in non-use furled configuration in a spiral column projecting outwardly from the cylindrical member.

1 Claim, 2 Drawing Sheets

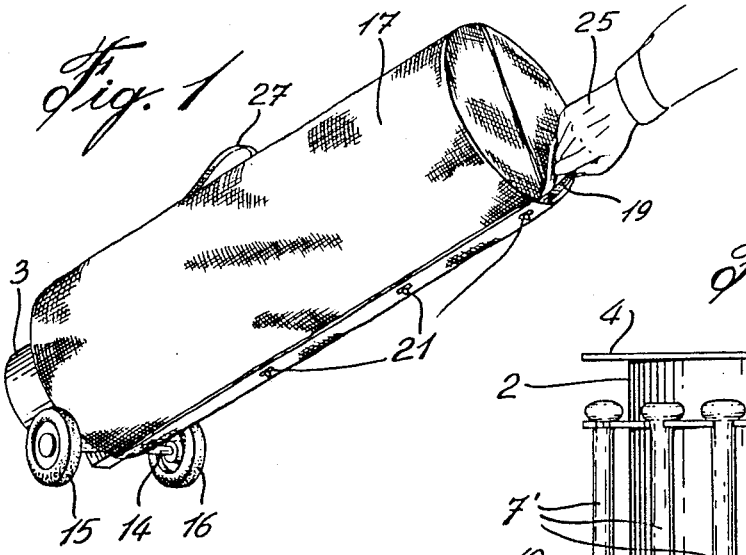
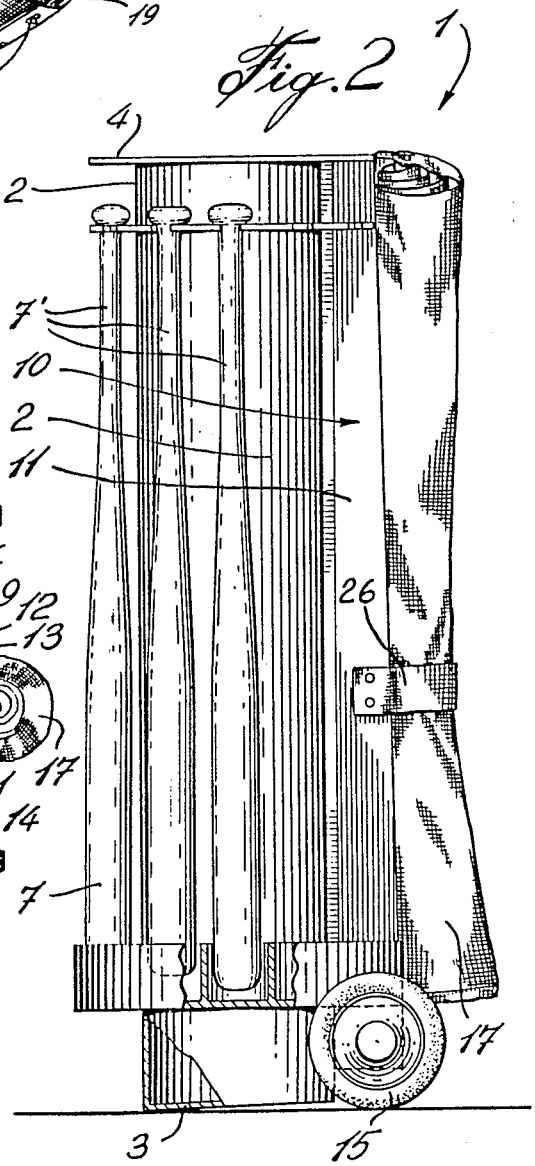
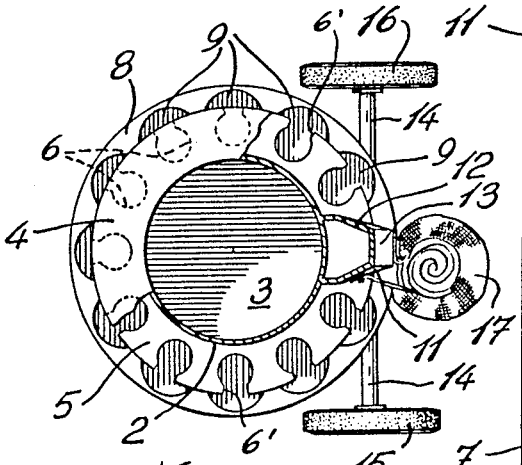
Fig. 3

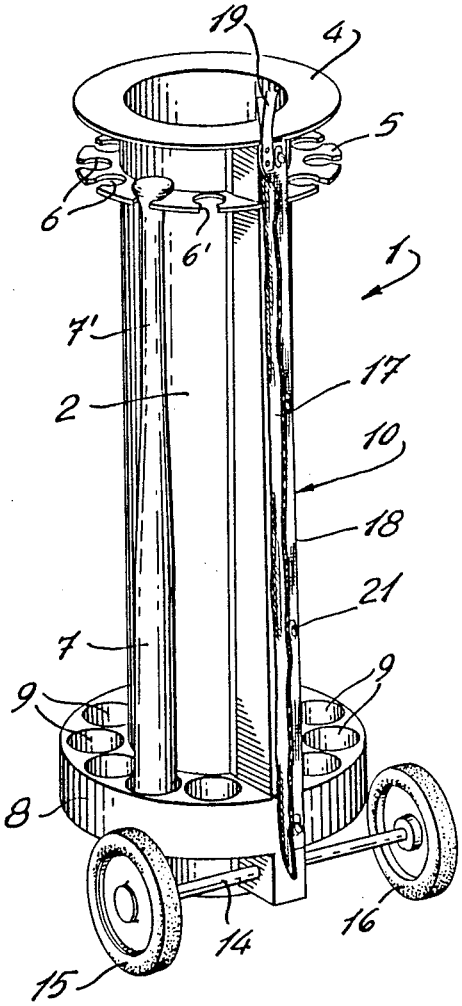
Fig. 4
Fig. 5
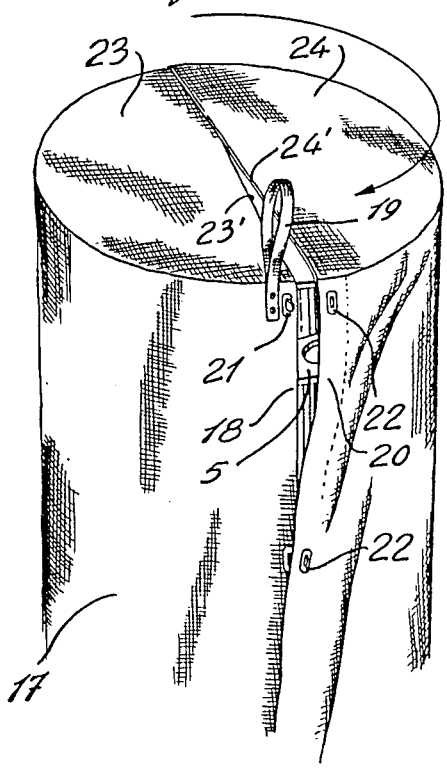

CADDY FOR BASEBALL AND SOFTBALL BATS

FIELD OF THE INVENTION

The present invention relates generally to carts intended to carry sports accessories, more specifically to a cart of such type having a protective cover.

BACKGROUND OF THE INVENTION

Originally baseball team players transported their equipment such as bats, gloves, balls, etc. in duffle bags or large heavy boxes. Accordingly, many attempts have been made since to provide improved or new conveyances to overcome the obvious disadvantages of duffle bags and large boxes alone. Some of these devices include carts having wheels. U.S. Pat. No. 3,869,137 discloses a portable storage cart for baseball-related equipment. While functional, that invention has many imperfections:

(a) the frame of the cart is relatively difficult to manufacture, being made of a plurality of different pieces;

(b) the cart has a central cylindrical space occupied by a duffle bag. The bag is attached to the frame and must consequently be detached for removal. Also, a duffle bag used in this way is prone to tearing and may bulge outwardly against the bats when full, thereby making removal or some of the latter difficult (see FIG. 1);

(c) the location of the wheels of the cart renders the cart difficult to tilt properly for pulling or pushing to a different site when it is fully loaded.

Another U.S. Pat. No. 4,193,495 discloses a portable "organizer" for bats, helmets, etc. However, this article must be hung and if no fence, backstop or the like is available, its usefulness is significantly reduced.

Another U.S Pa. No. 4,227,710 teaches a wheeled device designed to carry baseball equipment. The device requires a pivotal leg to stay in a generally upright position. Straps are further needed to hold the various items in place. This is complicated construction.

OBJECTS OF THE INVENTION

In view of the above, it is an important object of the present invention to provide a cart for baseball equipment having a cover which has a furled non-use configuration and an enclosing, unfurled use configuration, the cover being attached to the cart in a permanent manner.

It is another important object of the present invention to provide a cover of the character described, which is easily and quickly unfurled or furled.

It is yet another object of the present invention to provide a cart wherein the cover protects all the items carried by the cart.

SUMMARY OF THE INVENTION

The above and other objects and advantages of the present invention are realized according to a preferred embodiment comprising an elongated rigid cylinder member having a closed lower end and an open upper end. The cylinder thus defines a cylindrical space in which may be stored sequentially for easy selection various items of equipment, such as gloves, baseballs, helmets, etc.

Retaining means extending all around the cylinder member at both the upper and lower portions thereof are provided to retain a plurality of baseball bats.

The cylinder member is further formed with an outwardly-projecting, longitudinal, elongated rib having an outer surface.

The lower portion of the rib has an axle extending transversely of the rib, the outer ends of the axle each carrying a wheel for pulling or pushing the cart over ground.

A protective cover, generally of a shape corresponding to and slightly larger than the contours of the retaining means has one of its lateral edges attached to the outer surface of the rib and is adapted to be unfurled around the retaining means. The top circumferential edge of the cover is formed with flap means to completely close over the opening of the cylinder member. The cover extends downwardly, having a lower edge preferably located adjacent the lower portion retaining means, thus fully protecting the cart. The other lateral edge of the cover is adapted to slightly overlap the first lateral edge when fully unfurled. Fastening means are provided to attach the two edges together. When furled, the cover assumes the shape of a narrow spiraled column at the front of the rib.

BRIEF DESCRIPTION OF THE DRAWINGS

The above will be more clearly understood by having referral to the preferred embodiment of the invention, illustrated by way of accompanying drawings, in which:

FIG. 1 is a perspective view of the cart, with the cover on, showing how the cart is pulled;

FIG. 2 is an elevational view of the cart of FIG. 1;

FIG. 3 is a top plan view of the cart, partially sectioned;

FIG. 4 is another perspective view of the cart, showing a first lateral edge portion of the cover secured thereto; and FIG. 5 is an enlarged perspective view of the upper portion of the cart showing how the cover fits around the upper portion.

Like numerals indicate like elements throughout the drawings.

DETAILED DESCRIPTION OF THE PREFERRED EMBODIMENT

Referring firstly to FIG. 2 and 4, there is shown a cart 1 according to the invention. Cart 1 consists of a rigid elongated cylinder member 2 having a bottom circular wall 3 and an open upper end. Member 2 may be made of molded plastic or a lightweight metal. An upper annular flange 4 is preferably integrally formed with member 2 at the upper edge of the latter.

Spaced below flange 4 is a first part of the retaining means, consisting of a second annular flange 5, having a plurality of generally circular notches 6, all having a narrowed opening 6'. Flange 5 is made of semi-resilient non-marring material, so that baseball or softball bats 7 may be easily snapped into a notch 6 at their grip areas 7'.

The second part of the retaining means is embodied by an annular disk 8 extending in spaced relationship above wall 3, as best seen in FIG. 2. The upper surface of disk 8 is provided with a plurality of vertical circular partitions forming upwardly opening blind bores 9, each blind bore 9 being diametrically larger than and in vertical register with one of the notches 6.

The distance between second flange 5 and the bottom of bores 9 is predetermined to accommodate the variations in length of bats 7, as suggested in FIG. 2. Thus, any bat 7 may be easily and quickly selected from the cart. The distance between upper flange 4 and second flange 5 is about equal to the depth of blind bores 9, so that the bats 7 will hit flange 4 and still be retained in blind bores 9 if the cart is accidentally inverted. The cart 1 is further formed with an elongated outwardly projecting rib 10. The latter is formed of a pair of outwardly-convering side walls 11 and 12, which are joined by a flat outer surface 13. Rib 10 extends from upper flange 4 almost to the bottom wall 3 of cylinder member 2 and below disk 8.

An axle 14 extends transversely through the lower portion of rib 10, its opposite ends carrying a pair of rotatively-mounted wheels 15 and 16.

Secured to flat surface 13 and extending from the lower edge of disk 8 to upper flange 4, is a protective cover 17. Cover 17 is made of waterproof, flexible material and is fixed to surface 13 by one of its lateral edge portion 18.

FIG. 5 shows cover 17 in fully-unfurled configuration. A handle 19 for pulling the cart by a hand 25 is secured to the cover at the upper area of lateral edge portion 18. As shown, cover 17 is unfurled from the stored configuration of FIG. 2 in a clockwise direction.

The other lateral edge portion 20 of the cover is adapted to slightly overlap lateral edge portion 18 when the cover is fully unfurled. Lateral edge portions 18, 20 are provided with fastening means consisting of a plurality of vertically-spaced twist clasps 21 secured to edge 18 and complementary slots 22 secured in edge portion 20.

The flap means referred to above consists of a pair of semi-circular flaps 23 and 24 stitched or otherwise secured to the semi-circular upper edges of the cover. The straight edges of both flaps are free. Straight edge 24' overlaps straight edge 23' in water-tight relationship. A strap 26, or the like, is secured to rib 10 to maintain cover 17 in furled non-use condition at the front of rib 10.

Preferably, a second handle 27 is secured to cover 17 diameterically opposite rib 10 intermediate the length of the cover, so that the cart can be carried manually. An additional feature (not shown) may include a hollow hand space in the lower surface of disk 8, such space being located along the same vertical line defined by handle 27. Thus, the cart may be easily grasped with both hands and carried.

It is to be noted that, when cart 1 is being pulled or pushed, the two lateral edge portions 18 and 20 are located closest to the ground, thereby further protecting against rain.

Cover 17 is of dimensions to fit in a generally snug way around the contours of the cart. Flange 4 provides a good support for the marginal portion of the top of cover 17.

It is to be further noted that, since cover 17 is permanently secured to the cart, there is no possibility that it will get lost.

I claim:

1. A baseball equipment cart comprising, in combination: an elongated rigid cylinder member having a closed lower end and an open upper end; a first annular flange fixed to and surrounding said cylinder member at said upper end; a second annular flange fixed to and surrounding said cylinder member and spaced below said first flange and having a plurality of spaced circular notches all having a narrow opening for hangingly supporting baseball bats; an annular disk fixed to and surrounding said cylinder spaced above said lower end and provided with a plurality of upstanding circular partitions defining upwardly opening blind bores, each blind bore being in register with one of said circular notches, said first flange overlying said notches, the distance between said first and said second flanges being about equal to the depth of said blind bores, whereby bats hung in the notches of said second flange will hit said first flange while still retained in said blind bores if the cart is inverted, said cylinder serving as a container for items of baseball equipment; further comprising an elongated rib projecting outwardly from the surface of said cylinder member longitudinally thereof; a pair of wheels mounted at opposite sides of the lower portion of said rib; a protective cover having a first lateral edge permanently secured to said rib; said cover further having a second free lateral edge; said cover when opened having a furled configuration at said rib, strap means for detachably surrounding said furled cover, said cover, when released by said strap means, capable of taking a closed, unfurled configuration around the cart, wherein said second lateral edge slightly overlaps said first lateral edge; said cover further having flap means to close said open upper end; fastening means to releasably fasten said first and second lateral edges when the cover is in closed unfurled configuration; at least one handle attached to said cover exteriorly thereof, for moving said cart; a distal end section of said cylinder member closed lower end, relative to the rotational axis of said wheels, resting on the ground together with said wheels when said cart stands freely in an upright position on the ground, wherein said cylinder member closed lower end is slightly upwardly inclined starting from said distal end section thereof.

* * * * *